US007497085B2

(12) United States Patent
Ruocco-Angari

(10) Patent No.: US 7,497,085 B2
(45) Date of Patent: Mar. 3, 2009

(54) REFRIGERATING MACHINE USING THE STIRLING CYCLE

(75) Inventor: Bernard Ruocco-Angari, Paris (FR)

(73) Assignee: Sagem Defense Securite, Paris (FR)

( * ) Notice: Subject to any disclaimer, the term of this patent is extended or adjusted under 35 U.S.C. 154(b) by 263 days.

(21) Appl. No.: 11/346,601

(22) Filed: Feb. 2, 2006

(65) Prior Publication Data

US 2006/0179850 A1 Aug. 17, 2006

(30) Foreign Application Priority Data

Feb. 3, 2005 (FR) ..... 05 01100

(51) Int. Cl.

| | |
|---|---|
| ***F25B 9/00*** | (2006.01) |
| ***F01N 5/02*** | (2006.01) |
| ***F02G 1/04*** | (2006.01) |
| ***F01B 29/10*** | (2006.01) |

(52) U.S. Cl. ..... 62/6; 60/520

(58) Field of Classification Search ..... 62/6; 60/517, 520

See application file for complete search history.

(56) References Cited

U.S. PATENT DOCUMENTS

| | | | | |
|---|---|---|---|---|
| 3,431,788 | A * | 3/1969 | Du Pre | 74/44 |
| 3,845,624 | A * | 11/1974 | Roos | 60/517 |
| 4,206,609 | A | 6/1980 | Durenec | |
| 4,365,982 | A * | 12/1982 | Durenec | 62/6 |
| 5,077,977 | A * | 1/1992 | Manor | 62/6 |
| 5,345,765 | A * | 9/1994 | Kinnersly | 60/525 |
| 6,136,987 | A * | 10/2000 | Fruh et al. | 123/48 B |
| 6,546,900 | B2 * | 4/2003 | Arai et al. | 123/48 B |
| 6,622,670 | B2 * | 9/2003 | Hiyoshi et al. | 123/48 B |
| 6,729,131 | B2 * | 5/2004 | Kocsisek | 60/517 |
| 7,191,596 | B2 * | 3/2007 | Yaguchi et al. | 60/517 |
| 2004/0112048 | A1 * | 6/2004 | Chien et al. | 60/517 |

FOREIGN PATENT DOCUMENTS

| | | |
|---|---|---|
| BE | 1011918 | 3/2000 |
| FR | 2084109 | 12/1971 |
| JP | 08219569 | 8/1996 |
| JP | 10019406 | 1/1998 |
| JP | 1103704 | 3/1999 |

OTHER PUBLICATIONS

French Search Report for related French Application FR 05 01100.

* cited by examiner

*Primary Examiner*—William C Doerrler
(74) *Attorney, Agent, or Firm*—McDonnell Boehnen Hulbert & Berghoff LLP

(57) ABSTRACT

A cooler machine using the Stirling cycle and comprising: at least one compressor with a compressor piston movable in a compression cyclinder; a regenerator with a regenerator piston movable in a regeneration cyclinder placed at a given angle relative to the compression cyclinder; a rotary drive crank; and two connecting rods, respectively a compressor connecting rod coupled to the compressor piston, and a regenerator connecting rod coupled to the regenerator piston, and both coupled to the crank with a mutual angular offset; the compressor and/or regenerator connecting rod is arranged to be of length that is variable over a rotation of the crank in such a manner that the movement of the corresponding piston is least slowed down on passing through top and/or bottom dead center.

9 Claims, 4 Drawing Sheets

REFRIGERATING MACHINE USING THE STIRLING CYCLE

This application claims priority under 35 U.S.C. § 119, via the Paris Convention for the Protection of Industrial Property, to French patent application number FR 05 01100, filed Feb. 03, 2005, which is hereby incorporated by reference.

FIELD OF THE INVENTION

The present invention relates to improvements provided to cooler machines using the Stirling cycle and comprising:

at least one compressor with a compressor piston movable in a compression cylinder;

a regenerator with a regenerator piston movable in a regeneration cylinder placed at a given angle relative to the compression cylinder;

a rotary drive crank; and two connecting rods, respectively a compressor connecting rod coupled to the compressor piston, and a regenerator connecting rod coupled to the regenerator piston, and both coupled to the crank with a mutual angular offset.

DESCRIPTION OF THE PRIOR ART

It is recalled that the Stirling cycle comprises:

isothermal compression at the hot temperature $T_c$ (from 1 to 2 in FIG. 1) obtained by moving one or more compressor piston(s)—also referred to as "oscillator(s)"—;

isochoric (i.e. constant volume) cooling from the hot temperature $T_c$ to the cold temperature $T_f$ (from 2 to 3) achieved by passing gas through a porous piston referred to as a regenerator—or a displacer—acting as a heat exchanger;

isothermal expansion at the cold temperature $T_f$ (from 3 to 4) obtained by returning the compressor piston; and isochoric heating from the cold temperature $T_f$ to the hot temperature $T_c$ (from 4 to 1) obtained by returning from the regenerator.

FIG. 1 plots isotherms in the pressure/volume (ordinate/abscissa) plane: under steady conditions, the Stirling cycle is represented by the curvilinear trapezoidal quadrilateral A having vertices 1, 2, 3, and 4 lying between the isotherms $T_c$ and $T_f$ (the Clapeyron or pV diagram); the area W represents the work that needs to be supplied to the gas in order to describe the cycle, and the area $Q_f$ represents the cooling energy delivered to the cold source.

To follow the Stirling cycle, it is necessary to move each piston—compressor piston or regenerator piston—only while the other piston is stable in its top dead center (TDC) or its bottom dead center (BDC) position. If this condition is not satisfied, then the angular portions of the Stirling cycle (points 1 to 4 of the pV diagram) are not reached and the representation of the cycle takes on a curvilinear shape as shown by dashed line B in FIG. 1.

Cooler machines that operate using the Stirling cycle can be subdivided into two categories: united-cycle type machines and so-called "split-cycle" machines. Neither implements the theoretical Stirling cycle exactly (cycle A).

FIG. 2 is a highly diagrammatic representation of a cooler machine of the united-cycle type using the Stirling cycle. This machine comprises:

at least one compressor 5 having a compressor piston 6 that is movable in a compression cylinder 7;

a regenerator 8 with a regenerator piston 9 movable in a regeneration cylinder 10 positioned at a given angle relative to the compression cylinder 7, and in particular being substantially perpendicular thereto, as shown;

a rotary drive crank 11; and two connecting rods, respectively a compressor connecting rod 12 pivotally coupled to the compressor piston 6, and a regenerator connecting rod 13 pivotally coupled to the regenerator piston 9, which connecting rods 12 and 13 are pivotally coupled to the crank 11 at the same location 14, with a mutual angular offset, in particular an offset of about 90°.

In united-cycle machines, the compressor piston 6 and the regenerator piston 9 are driven by the same motor via a double connecting rods—crank system (crank 11 and connecting rods 12 and 13 coupled at 14). The two pistons 6 and 9 perform respective movements that are almost sinusoidally reciprocating rectilinear movements. The phase offset between the two pistons 6 and 9 is constant and depends on the point where the two connecting rods are anchored to the crank. This phase offset is generally 90°. Cooling power is determined by adjusting the speed of rotation of the motor, and thus of the number of thermodynamic cycles performed per unit time.

In FIG. 2, the same references 1 to 4 are used to designate the angular positions of the crank 11 corresponding to the vertices 1 to 4 of the Stirling cycle shown in FIG. 1.

In practice, compared with the theoretical Stirling cycle, the central difference lies in the fact that the transitions of each piston begin before the other piston has reaches the end of its stroke. As shown in the diagram of FIG. 1, the consequence is that the representation of the real cycle B in the pV plane becomes rounded and the vertices 1 to 4 of the theoretical cycle A are no longer reached.

Compared with the theoretical Stirling cycle, the cooling energy and the work to be delivered are greatly reduced (by a factor of 2 or more), for identical coefficient of performance (i.e. the ratio of these two terms). This amounts to saying that coupling the two piston 6 and 9 by means of the linkage 12, 13 leads to a cooler machine being made that is of reduced power. In order to obtain cryogenic power that is equal to that of the theoretical Stirling cycle, it is therefore necessary to increase the mass of gas that is displaced in unit time:

by causing the machine to run faster (to implement more cycles per unit time); and/or by increasing the cylinder capacity and/or the filling pressure (to increase the mass of gas per cycle).

These solutions have a negative impact on reliability, noise, mass, and bulk of the machine.

With split-cycle machines (not shown), only the compressor piston is driven:

by a motor via a connecting rod in rotary machines;

by a linear motor driving a resonant mass-spring system in linear machines.

In both cases, the movement of the compressor piston(s) is sinusoidal or quasi-sinusoidal.

The cryogenic power is matched to demand by adjusting the speed of rotation of the motor in the first case, or by adjusting the amplitude of oscillation in the second case. The regenerator piston is not driven by a motor or an actuator, but by the pressure wave that comes from the compressor and that is transmitted via a pipe (or transfer line). The phase offset is obtained by the combination of forces acting on the regenerator (friction, pressure wave effect, a return spring, a pressure reference, . . . ). The movement of the regenerator is periodic (not necessarily sinusoidal) at the frequency of the pressure wave. The phase offset is more or less variable as a function of ambient temperature, wear, . . . .

To sum up, existing cooling machines operating using the Stirling cycle do not enable the ideal Stirling cycle to be implemented because of the way in which coupling is achieved between the compressor and the regenerator (not to mention departures from the theoretical cycle that are due to other causes). This means that the cryogenic power is greatly diminished.

SUMMARY OF THE INVENTION

An object of the invention is thus to propose an improved technical solution seeking to optimize the displacements of the pistons in order to tend as well as possible towards the Stirling cycle, i.e. to slow down (ideally to stop) the periodic movement of the pistons in the vicinity of their top and bottom dead center positions, but without that leading to excessive complication in structure or in manufacture.

For these purposes, the invention provides a cooler machine as mentioned in the preamble part which, when in accordance with the invention, is characterized in that at least one of the compressor piston and the regenerator piston is arranged to be of length that is variable over a rotation of the crank so that the movement of said piston is at least slowed down while passing through the top and bottom dead center positions.

By means of this disposition, the operating cycle of the machine comes closer to the theoretical Stirling cycle than does that of rigid connecting rod cooler machines that have been made in the past.

In a preferred embodiment of the fundamental dispositions of the invention, provision is made for the variable length connecting rod, referred to below as the main connecting rod, to be built up in the form of at least two connecting rod segments that are hinged to each other, and for at least one auxiliary link to possess a first end pivotally coupled to the main connection rod and a second end pivotally coupled to a structural element of the machine.

In this context, arrangements can be made for the first end of the auxiliary link to be pivotally coupled to the joint interconnecting the two segments of the main connecting rod, or else for the first end of the auxiliary link to be pivotally coupled to one of the segments of the main connecting rod, and in particular to that one of the segments of the main connecting rod that is secured to the piston.

If additional structural complication can be accepted, it is possible to have a number n of hinged-together connecting rod segments that is greater than 2, in which case the number of auxiliary links is equal to n−1.

Concerning the second end of the auxiliary link, provision can be made for it to be pivotally coupled to a stationary element of the structure of the machine: although such an embodiment is structurally simple, it nevertheless leads to a result that is advantageous in terms of improving the operating cycle of the machine, and significantly approaches the theoretical Stirling cycle. However, if greater structural and functional complexity can be accommodated, it is possible, in another embodiment, for the second end of the auxiliary link to be pivotally coupled to a moving element of the structure of the machine, and for control means to control the movement of the moving element of the structure.

Dispositions in accordance with the invention can be implemented regardless of the type of cooler machine involved: if the cooler machine is of the united-cycle type, it can be the respective crank shafts of both the compressor piston and of the regenerator piston that are arranged to be of respective variable lengths, or else for reasons of cost and/or simplification, the variable length can apply to only one of these connecting rods, and in particular to the regenerator connecting rod since the forces that are applied to the regenerator piston are much lower than the forces that are applied to the compressor piston; if the cooler machine is of the split-cycle type, then it is the compressor connecting rod that is arranged to have variable length.

With a regenerator including a connecting rod that is modified in accordance with the invention in order to slow down movement in the vicinity of top dead center (TDC), cooling of the gas by the regenerator is retarded compared with a conventionally arranged machine (i.e. almost at the end of compression) . Similarly, if the movement of the regenerator piston is slowed down at bottom dead center (BDC) by implementing a connecting rod modified in accordance with the invention, then return of the gas to the hot temperature is retarded, almost at the end of expansion. Thus, by combining these effects, the operating cycle is brought closer to the vertex points 2 and 4 of the theoretical Stirling cycle.

Similarly, implementing the dispositions of the invention on the connecting rod of the compressor piston can make it possible to modify the operating cycle by extending the theoretical Stirling cycle towards the vertex points 1 and 3.

The main advantage obtained by implementing means in accordance with the invention is obtaining a cycle that is closer to the ideal cycle (the Stirling cycle) , and thus increasing the cryogenic power of the cooler machine for given bulk.

For given cryogenic power, a cooling machine fitted in accordance with the invention can rotate more slowly, thereby indirectly improving its thermodynamic efficiency because certain losses are reduced, such as losses by the "appendix" effect or losses due to fluid friction. In addition, rotating at a slower speed helps improve reliability.

BRIEF DESCRIPTION OF THE DRAWINGS

The invention can be better understood on reading the following detailed description of certain preferred embodiments given purely as non-limiting examples. In the description, reference is made to the accompanying drawings, in which.

DETAILED DESCRIPTION OF THE INVENTION

Figure 1:
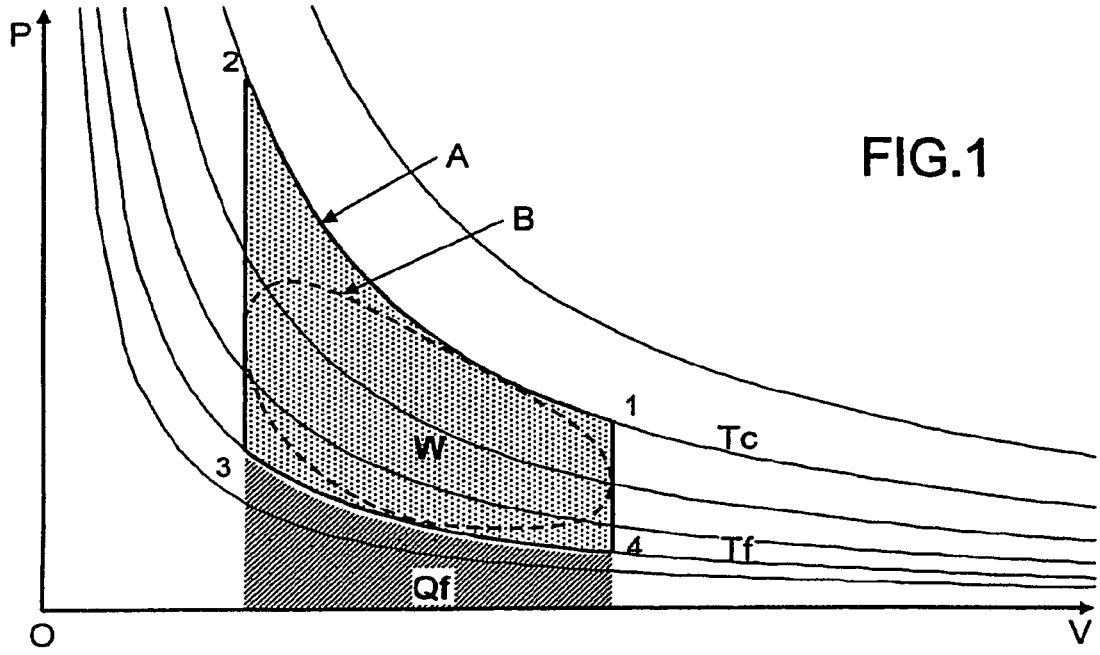
FIG. 1 is a volume/pressure (abscissa/ordinate) diagram showing a theoretical Stirling cycle and the cycle of a conventional cooler machine.
Figure 2:
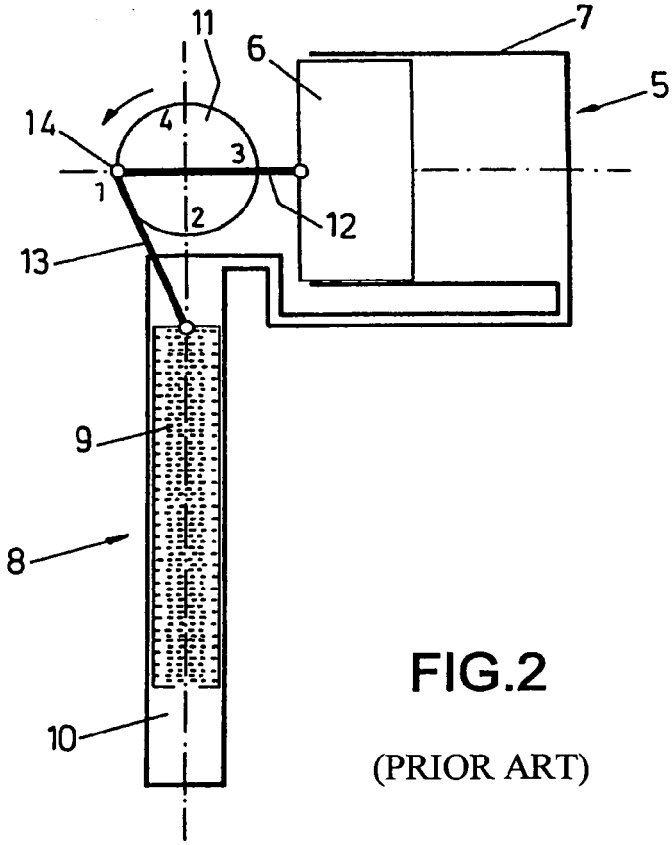
FIG.2 (PRIOR ART)
FIG. 2 is a highly diagrammatic view of a conventional cooler machine of the united-cycle type implementing the Stirling cycle.

In accordance with the invention, provision is made for the connecting rod or at least one of the connecting rods of the cooler machine to be arranged to be of length that varies during one rotation of the crank so that the movement of the corresponding piston is at least slowed down, or possibly even stopped, on going through top dead center and/or bottom dead center, and preferably both, so that the operating cycle of the machine comes closer to the theoretical Stirling cycle than do the cooler machines with rigid connecting rods that have been made until now.

Various technical solutions can be envisaged for this purpose.

The solution that appears to be the most appropriate for achieving a compromise that is satisfactory in terms of structural simplicity and in terms of quality of the result obtained, consists, as shown in FIGS. 3A to 3D, in that the variable length connecting rod (assumed by way of example below to be the compressor connecting rod 12), referred to below as the main connecting rod, is made up of at least two connecting rod segments 12*a*, 12*b* that are hinged to each other at 15, and in that at least one auxiliary link 16 presents a first end pivotally coupled at 17 to the main connecting rod 12 and a second end pivotally coupled at 18 to a structural element 19 of the machine. The characteristics of the arrangement—and in particular the lengths of the connecting rod segments 12*a* and 12*b*, the locations of the hinges 15 and 17, the length of the auxiliary link 16, the arrangements of the hinge 18 and of the structural element 19 of the machine—should all be determined as a function of the desired result.

A variety of practical embodiments can be envisaged.

Figure 3A:
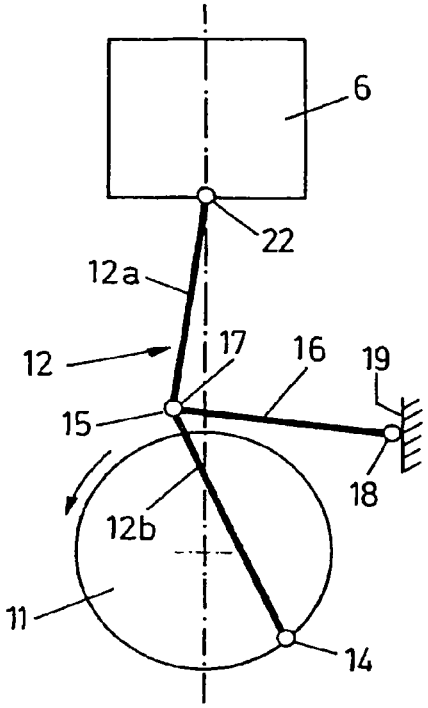
FIGS. 3A to 3D are highly diagrammatic views of a plurality of respective variants of the arrangement proposed by the invention.

The embodiment shown in FIG. 3A is the simplest from the structural point of view. The hinge 15 uniting the two segments 12*a*, 12*b* of the connecting rod and the hinge 17 uniting the auxiliary link 16 to the main connecting rod 12 coincide.

Figure 3B:
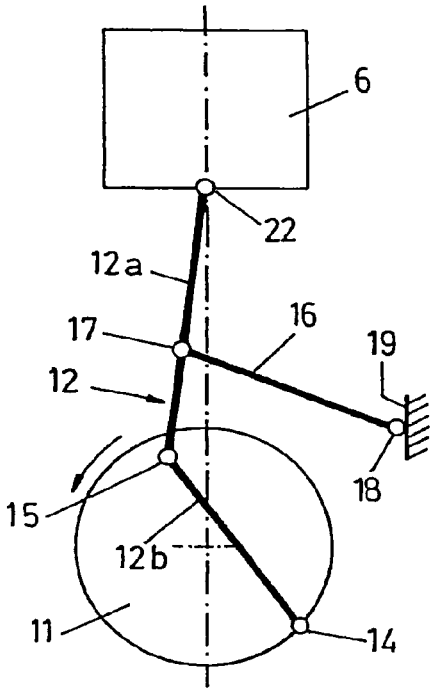

In the variant embodiment shown in FIG. 3B, the two hinges 15 and 17 are distinct and the hinge 17 is offset onto one of the segments of the connecting rod, e.g. the connecting rod segment 12*a* that is connected to the piston as shown in FIG. 3B. The position of the hinge 17 on the connecting rod segment is selected so as to define an appropriate lever arm for obtaining the desired movement of the piston 6.

Naturally, where appropriate, the main connecting rod 12 could be made up of a larger number of segments. The variant embodiment shown in FIG. 3C makes use of a main connecting rod subdivided into three rod segments 12*a*, 12*b*, and 12*c* united by hinges 15*a* and 15*b*; two auxiliary links 16*a*, 16*b* are interposed respectively between the hinges 15*a* and 15*b* and a structural element 19 of the machine; the two auxiliary links 16*a* and 16*b* may be united to the structural element 19 via a common hinge 18, or else via two respective hinges 18*a* and 18*b* that are distinct, as shown in FIG. 3C.

Figure 3C:
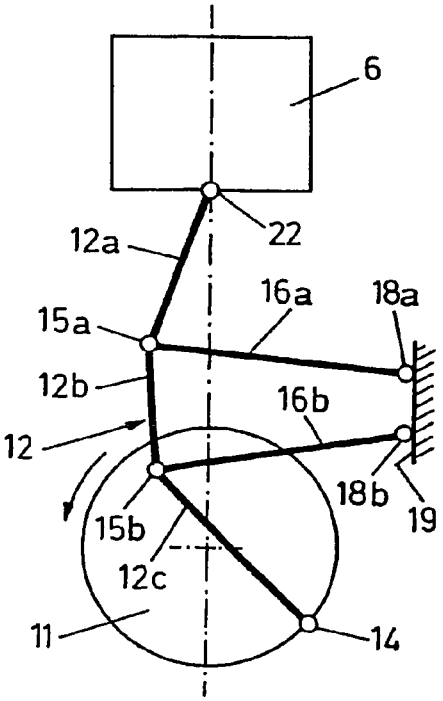
Figure 3D:
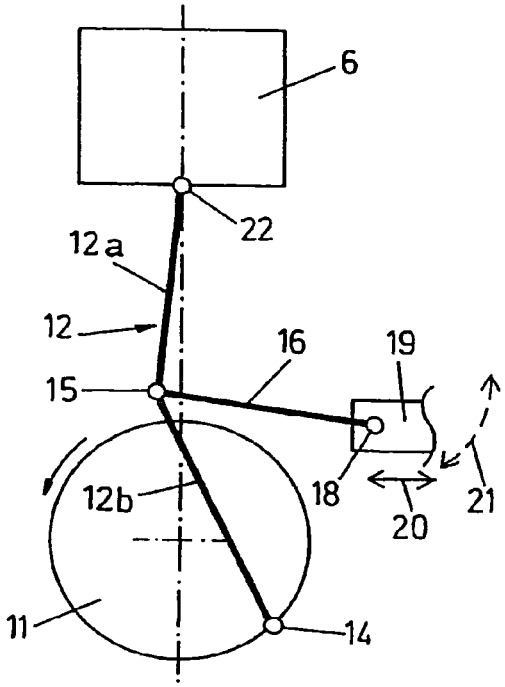

The structural element 19 of the machine to which the auxiliary link 16 is hinged may be constituted, in simple manner, by a stationary element of the structure of the machine, as shown in FIGS. 3A, 3B, and 3C. Nevertheless, it is possible to envisage that the hinge 18 is carried by a structural element that can be moved in controlled manner so that the hinge 17 is driven by an additional component of motion enabling the motion of the piston 6 to be controlled more finely. As shown in FIG. 3D (reproducing the simplest variant of FIG. 3A), the structural element 19 may be driven by control means (not shown) to move in substantially linear manner (arrow 20), or else in curvilinear manner, in particular substantially along a circular arc or a circle (arrow 21), or indeed along any suitable path. When a plurality of auxiliary links are implemented, the structural element 19 could include not only the dispositions mentioned above (elements that are stationary or movable), but could also comprise a combination of such dispositions (stationary structural elements for some auxiliary links and movable elements for others).

Figure 5:
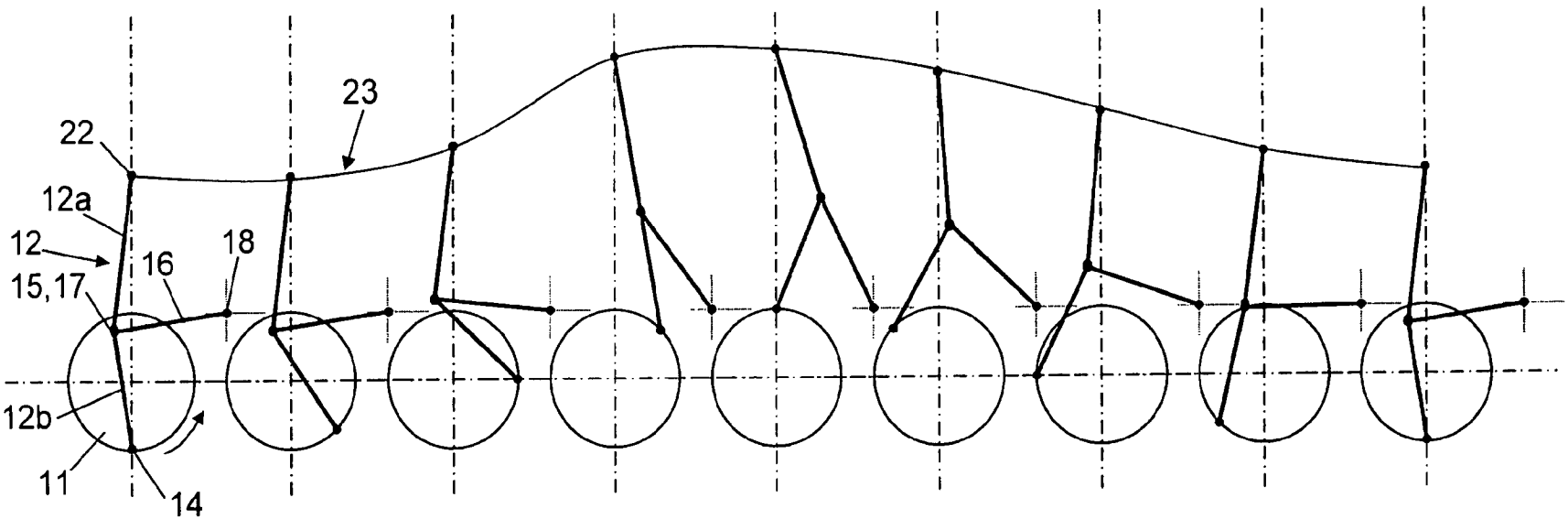
FIG. 5 is a developed diagram showing the movements of the piston and the connecting rods for one complete revolution of the crank in the simple assembly configuration of FIG. 3A.

By way of concrete example, FIG. 5 is a highly diagrammatic view showing how the piston moves in the simplest structural configuration corresponding to the arrangement of FIG. 3A. In FIG. 5, there can be seen only the hinge 22 of the rod segment 12*a* connected to the piston 6, while the piston itself is not shown in order to make the drawing easier to read. It can clearly be seen that the hinge 22 is driven with motion (subdivided along a path 23) which, for one turn of the crank 11, is no longer symmetrical or sinusoidal, but becomes asymmetrical between up and down movements and which is highly flattened (piston slowed) in the vicinity of the top and bottom dead centers while being steeper (piston accelerated) in the transitions between the top and bottom dead centers.

The dispositions in accordance with the invention are found to be particularly advantageous in that they apply to both types of cooler machine operating using the Stirling cycle.

Figure 4B:
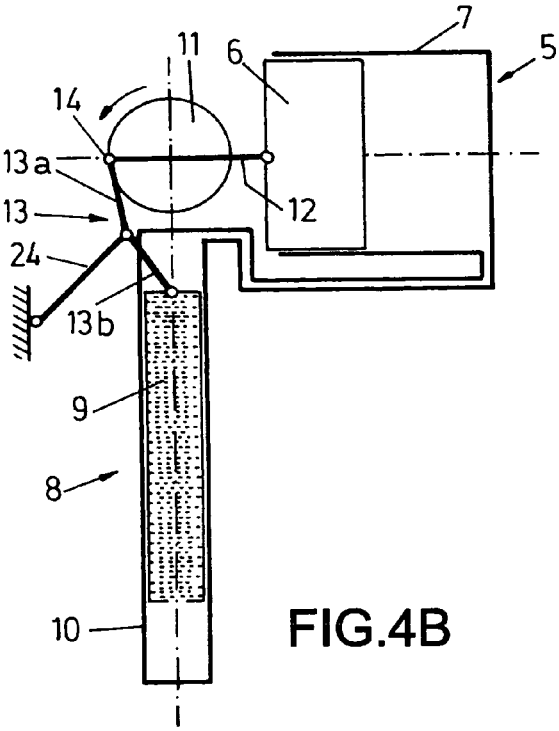
FIGS. 4A and 4B are views respectively of two embodiments of cooler machines of the united-cycle type arranged in accordance with the invention.
Figure 4A:
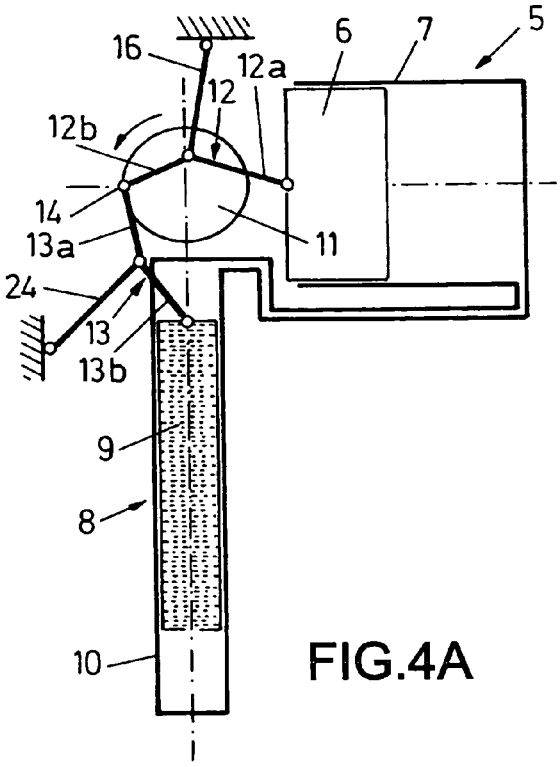

In united-cycle type machines, the connecting rods 12 and 13 respectively of the compressor piston 6 and of the regenerator piston 9 can be arranged to have respective variable lengths as shown in FIG. 4A. For the compressor 5, the arrangement of FIG. 3A can be used, for example, with the connecting rod 12 being made up of two segments 12*a* and 12*b* and with one auxiliary link 16. For the regenerator 8, it is possible to use an analogous arrangement, with the connecting rod 13 being made up of two segments 13*a* and 13*b* in association with a single auxiliary link 24.

Nevertheless, if the arrangement of the invention with two connecting rods 12 and 13 for compression and for regeneration is found to be too complex and/or too expensive, it is possible to fit only one of these connecting rods in accordance with the invention. Under such circumstances, it is preferable and more advantageous for the regenerator connecting rod 13 to be arranged to be of variable length as shown in FIG. 4B, given that the forces applied to the regenerator piston are smaller than the forces applied to the compressor piston.

In machines of the split-cycle type, it is the connecting rod for the compressor piston that is arranged to be of variable length.

Figure 6:
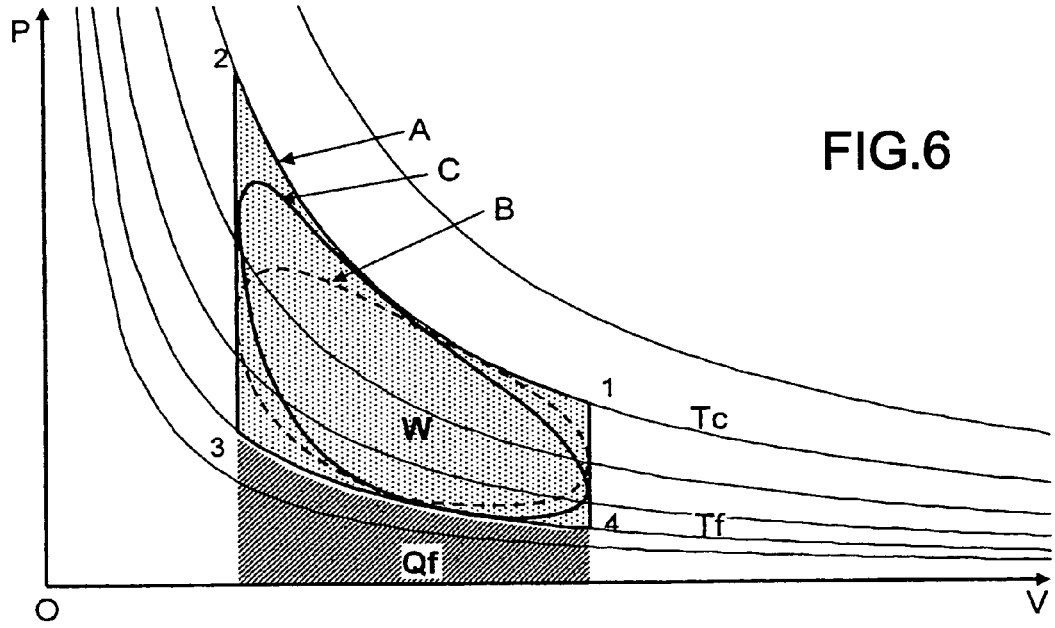
FIG. 6 is a diagram analogous to that of FIG. 1 also showing the operating cycle of a cooler machine arranged in accordance with the invention.

To sum up, implementing the dispositions in accordance with the invention makes it possible to modify the operating cycle of the cooler machine, and compared with the cycle B for a conventional machine, the invention makes it possible to move closer to the theoretical Stirling cycle A in the vicinity of at least some of its vertex points 1, 2, 3, and 4. The diagram of FIG. 6 is analogous to that of FIG. 1 and shows the theoretical Stirling cycle A again together with the cycle B of a conventional machine plotted using dashed lines, while a solid line has been used to add the cycle C of a cooler machine that has been modified in accordance with the invention so as to improve the cycle in the vicinity of its two vertex points 2 and 4 by slowing down the movement of the regenerator piston in the vicinity of its top and bottom dead centers. Applying the invention to the compressor piston would make it possible in the same manner to improve the cycle in the vicinity of its two vertex points 1 and 3.

What is claimed is:

1. A cooler machine using the Stirling cycle and comprising:

at least one compressor with a compressor piston movable in a compression cylinder; a regenerator with a regenerator piston movable in a regeneration cylinder placed at a given angle relative to the compression cylinder;

a rotary drive crank;

a compressor connecting rod possessing a first end pivotally coupled to the compressor piston and a second end pivotally coupled to the crank;

a regenerator connecting rod possessing a first end pivotally coupled to the regenerator piston and a second end pivotally coupled to the crank;

wherein at least one of the compressor and regenerator connecting rods (a) is pivotally connected to a first end of an auxiliary link that has a second end pivotally coupled to a structural element of the machine, and (b) is comprised of at least two connecting rod segments pivotally connected to one another; and where the connecting rod segments and connected auxiliary link are arranged to move together with crank rotation so that the movement of the corresponding piston is slowed down on passing through its top or bottom dead center.

2. A cooler machine according to claim 1, wherein the structural element of the machine is stationary with respect to the piston cylinders.

3. A cooler machine according to claim 1, wherein the first end of the auxiliary link is pivotally coupled to the hinge pivotally connecting two connecting rod segments.

4. A cooler machine according to claim 1, wherein the first end of the auxiliary link is pivotally coupled to one of the connecting rod segments.

5. A cooler machine according to claim 4, wherein the first end of the auxiliary link is pivotally coupled to the connecting rod segment that is secured to the corresponding compressor or regenerator piston.

6. A cooler machine according to claim 1, wherein the structural element of the machine is movable and driven by control means to slow down the corresponding piston on passing through its top or bottom dead center.

7. A cooler machine according to claim 1, wherein the machine is of the united-cycle type, and the compressor connecting rods and the regenerator connecting rods of the compressor and regenerator pistons are both comprised of the connecting rod segments.

8. A cooler machine according to claim 1, wherein the machine is of the united-cycle type, and only the regenerator connecting rod is comprised of the connecting rod segments.

9. A cooler machine using the Stirling cycle of the split-cycle type comprising:

a rotary drive crank;

at least one compressor with a compressor piston movable in a compression cylinder;

a compressor connecting rod possessing a first end pivotally coupled to the compressor piston and a second end pivotally coupled to the crank;

wherein the compressor connecting rods (a) are pivotally connected to a first end of an auxiliary link that has a second end pivotally coupled to a structural element of the machine, and (b) is comprised of at least two connecting rod segments pivotally connected to one another; and where the connecting rod segments and connected auxiliary link are arranged to move with crank rotation so that the movement of the corresponding piston is slowed down on passing through its top or bottom dead center.

* * * * *